US011760591B2

(12) United States Patent
Tamura

(10) Patent No.: US 11,760,591 B2
(45) Date of Patent: Sep. 19, 2023

(54) SHEET STACKING DEVICE AND PRINTING APPARATUS

(71) Applicant: Tomonori Tamura, Kanagawa (JP)

(72) Inventor: Tomonori Tamura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/552,602

(22) Filed: Dec. 16, 2021

(65) Prior Publication Data

US 2022/0234848 A1 Jul. 28, 2022

(30) Foreign Application Priority Data

Jan. 22, 2021 (JP) ..... 2021-009055

(51) Int. Cl.
*B65H 3/48* (2006.01)
*B65H 29/14* (2006.01)
*B65H 29/12* (2006.01)

(52) U.S. Cl.
CPC ..... *B65H 3/48* (2013.01); *B65H 29/125* (2013.01); *B65H 29/14* (2013.01)

(58) Field of Classification Search
CPC .... B65H 29/14; B65H 29/125; B65H 29/245; B65H 29/246; B65H 29/247; B65H 2301/4461; B65H 2406/121; B65H 2406/122; B65H 2406/1211
USPC ..... 270/58.11
See application file for complete search history.

(56) References Cited

U.S. PATENT DOCUMENTS 5,445,372 A * 8/1995 Blaser ..... B65H 29/041 271/211
5,816,155 A * 10/1998 Stephan ..... B65H 29/041 101/232
6,273,417 B1 * 8/2001 Berlingen ..... B65H 29/041 271/211
6,394,448 B2 * 5/2002 Suzuki ..... B65H 29/02 271/189
6,802,256 B1 * 10/2004 Koch ..... B41F 23/06 101/424.1
7,954,816 B2 * 6/2011 Freitag ..... B65H 83/02 271/275
9,511,965 B2 * 12/2016 Hatano ..... B65H 31/32
9,821,978 B2 * 11/2017 Herrmann ..... B65H 31/02
11,274,008 B2 * 3/2022 Okada ..... B65H 43/00
11,325,802 B2 * 5/2022 Tamura ..... B65H 29/246
2008/0061498 A1 * 3/2008 Suzuki ..... B65H 29/28 271/264
2009/0166958 A1 * 7/2009 Miwa ..... B65H 29/041 271/207
2020/0130978 A1 4/2020 Tamura
(Continued)

FOREIGN PATENT DOCUMENTS

JP 2002-167106 6/2002
JP 2010-168218 8/2010

*Primary Examiner* — Leslie A Nicholson, III
(74) *Attorney, Agent, or Firm* — Harness, Dickey & Pierce, P.L.C.

(57) ABSTRACT

A sheet stacking device include a guide unit and a blower. The guide unit receives a downstream end of a sheet in a sheet conveyance direction and guides the sheet downstream in the sheet conveyance direction. The blower blows air toward the sheet guided by the guide unit. A region of the blower from which the air is blown is changeable in response to a size of the sheet.

14 Claims, 10 Drawing Sheets

(56) References Cited

U.S. PATENT DOCUMENTS

| | | | | |
|---|---|---|---|---|
| 2020/0156896 | A1* | 5/2020 | Tsuchiya | G03G 15/6573 |
| 2020/0299093 | A1* | 9/2020 | Tamura | B65H 29/247 |
| 2021/0347595 | A1* | 11/2021 | Takano | B65H 31/38 |

* cited by examiner

SHEET STACKING DEVICE AND PRINTING APPARATUS

CROSS-REFERENCE TO RELATED APPLICATION

This patent application is based on and claims priority pursuant to 35 U.S.C. § 119(a) to Japanese Patent Application No. 2021-009055, filed on Jan. 22, 2021, in the Japan Patent Office, the entire disclosure of which is hereby incorporated by reference herein.

BACKGROUND

Technical Field

Aspects of the present disclosure relates to a sheet stacking device and a printing apparatus.

Description of the Related Art

A certain printing apparatus includes a sheet stacking device including a guide unit. The guide unit holds a downstream end of a sheet with a guide part and guides the sheet downstream in a sheet conveyance direction. The printing apparatus may further include a blower that blows air toward the sheet near a sheet ejection port when the sheet is ejected.

SUMMARY

Embodiments of the present disclosure describe an improved sheet stacking device that includes a guide unit and a blower. The guide unit receives a downstream end of a sheet conveyed in a sheet conveyance direction and guides the sheet downstream in the sheet conveyance direction. The blower blows air toward the sheet guided by the guide unit. A region of the blower from which the air is blown is changeable in response to a size of the sheet.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
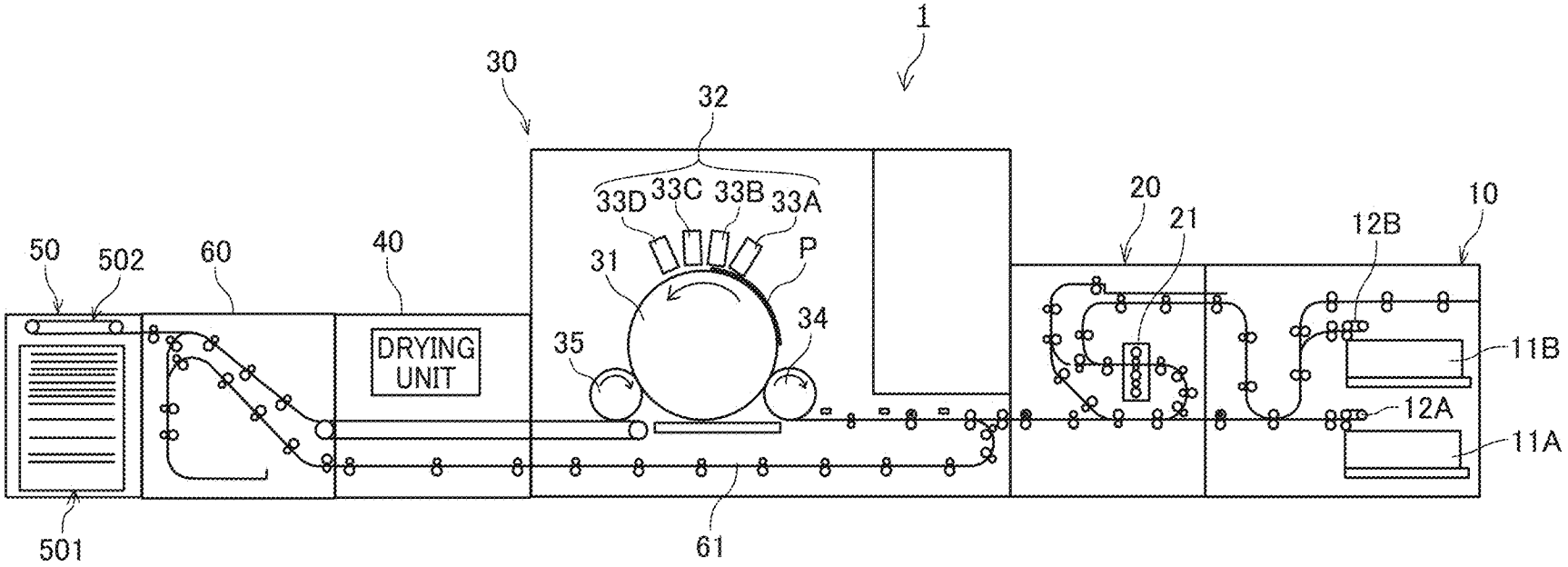
FIG. 1 is a schematic view of a printing apparatus as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a," "an," and "the" are intended to include the plural forms as well, unless the context clearly indicates otherwise.

Embodiments of the present disclosure are described below with reference to the accompanying drawings. First, a printing apparatus 1 as a liquid discharge apparatus according to a first embodiment of the present disclosure is described with reference to FIG. 1. FIG. 1 is a schematic view of the printing apparatus 1.

The printing apparatus 1 includes a loading unit 10 to load a sheet P, a pretreatment unit 20, a printing unit 30 as an image forming unit, a drying unit 40, an ejection unit 50, and a reverse mechanism 60. In the printing apparatus 1, the pretreatment unit 20 applies, as required, pretreatment liquid onto the sheet P forwarded (supplied) from the loading unit 10, the printing unit 30 applies liquid to the sheet P to perform printing on the sheet P, the drying unit 40 dries the liquid adhering to the sheet P, and the sheet P is ejected to the ejection unit 50.

The loading unit 10 includes a lower loading tray 11A and an upper loading tray 11B to accommodate a plurality of sheets P and feeders 12A and 12B to separate and forward the sheets P one by one from the lower and upper loading trays 11A and 11B, thereby supplying the sheets P to the pretreatment unit 20.

The pretreatment unit 20 includes, e.g., a coater 21 as a treatment-liquid applicator that coats a printing surface of the sheet P with, for example, treatment liquid having an effect of agglomerating colorant of ink to prevent bleed-through.

The printing unit 30 includes a drum 31 and a liquid discharger 32. The drum 31 is a bearer (rotator) that bears the sheet P on the circumferential surface of the drum 31 and rotates. The liquid discharger 32 discharges liquid toward the sheet P borne on the drum 31.

The printing unit 30 further includes transfer cylinders 34 and 35. The transfer cylinder 34 receives the sheet P from the pretreatment unit 20 and forwards the sheet P to the drum 31. The transfer cylinder 35 receives the sheet P conveyed by the drum 31 and forwards the sheet P to the drying unit 40.

The transfer cylinder 34 includes a sheet gripper to grip a leading end of the sheet P conveyed from the pretreatment unit 20 to the printing unit 30. The sheet P thus gripped is conveyed as the transfer cylinder 34 rotates. The transfer cylinder 34 forwards the sheet P to the drum 31 at a position opposite the drum 31.

Similarly, the drum 31 includes a sheet gripper on the surface thereof, and the leading end of the sheet P is gripped by the sheet gripper of the drum 51. The drum 31 has a plurality of suction holes dispersedly on the surface of the drum 31, and a suction unit generates suction airflows directed inward from suction holes of the drum 31.

On the drum 31, the sheet gripper grips the leading end of the sheet P forwarded from the transfer cylinder 34, and the sheet P is attracted to and borne on the drum 31 by the suction airflows by the suction unit. As the drum 31 rotates, the sheet P is conveyed.

The liquid discharger 32 includes discharge units 33 (discharge units 33A to 33D) to discharge liquids. For example, the discharge unit 33A discharges liquid of cyan (C), the discharge unit 33B discharges liquid of magenta (M), the discharge unit 33C discharges liquid of yellow (Y), and the discharge unit 33D discharges liquid of black (K). Further, the liquid discharger 32 may include a discharge unit 33 that discharges special liquid, that is, liquid of spot color such as white, gold, or silver.

The discharge operation of each of the discharge units 33 of the liquid discharger 32 is controlled by a drive signal corresponding to print data. When the sheet P borne on the drum 31 passes through a region facing the liquid discharger 32, the respective color liquids are discharged from the discharge units 33, and an image corresponding to the print data is printed on the sheet P.

The drying unit 40 dries the liquid applied onto the sheet P by the printing unit 30. Thus, a liquid component such as moisture in the liquid evaporates, and the colorant contained in the liquid is fixed on the sheet P. Additionally, curling of the sheet P is restrained.

The reverse mechanism 60 reverses, in switchback manner, the sheet P that has passed through the drying unit 40 in duplex printing. The reversed sheet P is fed back to the upstream side of the transfer cylinder 34 through a conveyance passage 61 of the printing unit 30.

The ejection unit 50 serves as an example of a sheet stacking device according to the present disclosure and includes a stacker 501 and a sheet conveyor 502. A plurality of sheets P is stacked on the stacker 501. The sheets P conveyed through the reverse mechanism 60 is sequentially stacked and held on the stacker 501.

Figure 2:
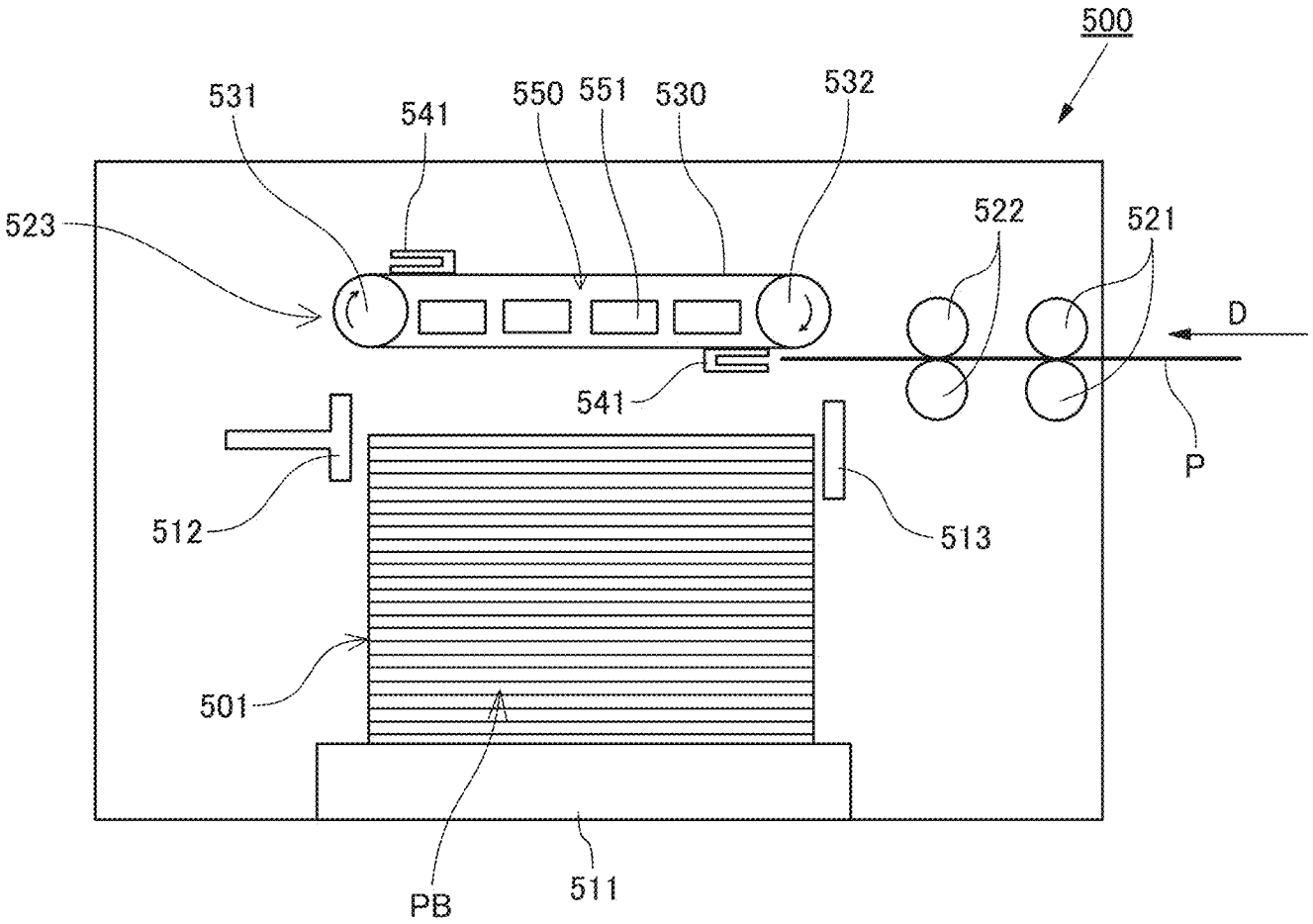
FIG. 2 is a schematic side view of a sheet stacking device according to the first embodiment of the present disclosure.

A sheet stacking device 500 according to the first embodiment of the present disclosure is described with reference to FIG. 2. FIG. 2 is a schematic side view of the sheet stacking device 500.

The sheet stacking device 500 includes the stacker 501 on which a sheet bundle PB (i.e. a bundle of the sheets P) is stacked. The stacker 501 includes a table 511, a leading end fence 512 (e.g., a sheet jogger), a trailing end fence 513, and side fences on both sides of the stacker 501. The sheet bundle PB is stacked on the table 511. The side fences are disposed on opposite sides in a direction perpendicular to a direction of conveyance of the sheet P indicated by arrow D in FIG. 2 (i.e., a sheet conveyance direction).

The sheet stacking device 500 further includes conveyance roller pairs 521 and 522 and a guide unit 523. The conveyance roller pairs 521 and 522 convey the sheet P fed from the reverse mechanism 60. The guide unit 523 receives a leading end (downstream end) of the sheet P conveyed from the conveyance roller pair 522 toward the stacker 501, and guides the sheet P downstream from the conveyance roller pair 522 in the sheet conveyance direction.

The guide unit 523 includes an endless belt 530 and guide parts 541. The endless belt 530 is looped around a drive roller 531 and a driven roller 532. The guide parts 541 are attached to the belt 530.

In the guide unit 523, the belt 530 circumferentially rotates around the drive roller 531 and the driven roller 532 after an elapse of a predetermined period of time from a timing of detection of the sheet P at an upstream of the conveyance roller pair 522. Then, the leading end of the sheet P is inserted into the guide part 541 due to a difference between a linear velocity of the guide part 541 and a linear velocity of the conveyance roller pair 522. For example, the linear velocity of the guide parts 541 is smaller than the linear velocity of the conveyance roller pair 522. Then, as the belt 530 rotates around the drive roller 531 and the driven roller 532, the guide part 541 moves downstream in the sheet conveyance direction (leftward direction in FIG. 2) while holding the leading end of the sheet P to guide the sheet P.

The guide part 541 has a gap wider than the thickness of the sheet P and does not have gripping force to grip the sheet P The leading end of the sheet P is merely inserted into the gap of the guide part 541. The guide part 541 also has a function of guiding the leading end of the sheet P and reducing flapping of the sheet P in a part of the sheet P from the leading end to a middle portion of the sheet P. The guide part 541 may include a clip having the gripping force for gripping the leading end of the sheet P.

When the guide part 541 reaches a guide end position, the linear velocity of the guide part 541 is set higher than the linear velocity of the conveyance roller pair 522. Thus, the leading end of the sheet P is separated from the guide part 541 and falls onto the stacker 501 to be stacked.

The sheet stacking device 500 further includes a blower 550 for blowing air toward the sheet P. The blower 550 is disposed inside the loop of the endless belt 530 in the vertical direction as viewed in the cross-section. As the blower 550 blows air to the sheets P, the stacked sheets P are pressed, and air accumulated between the sheets P is pushed out to the outside of the sheets P.

Figure 3:
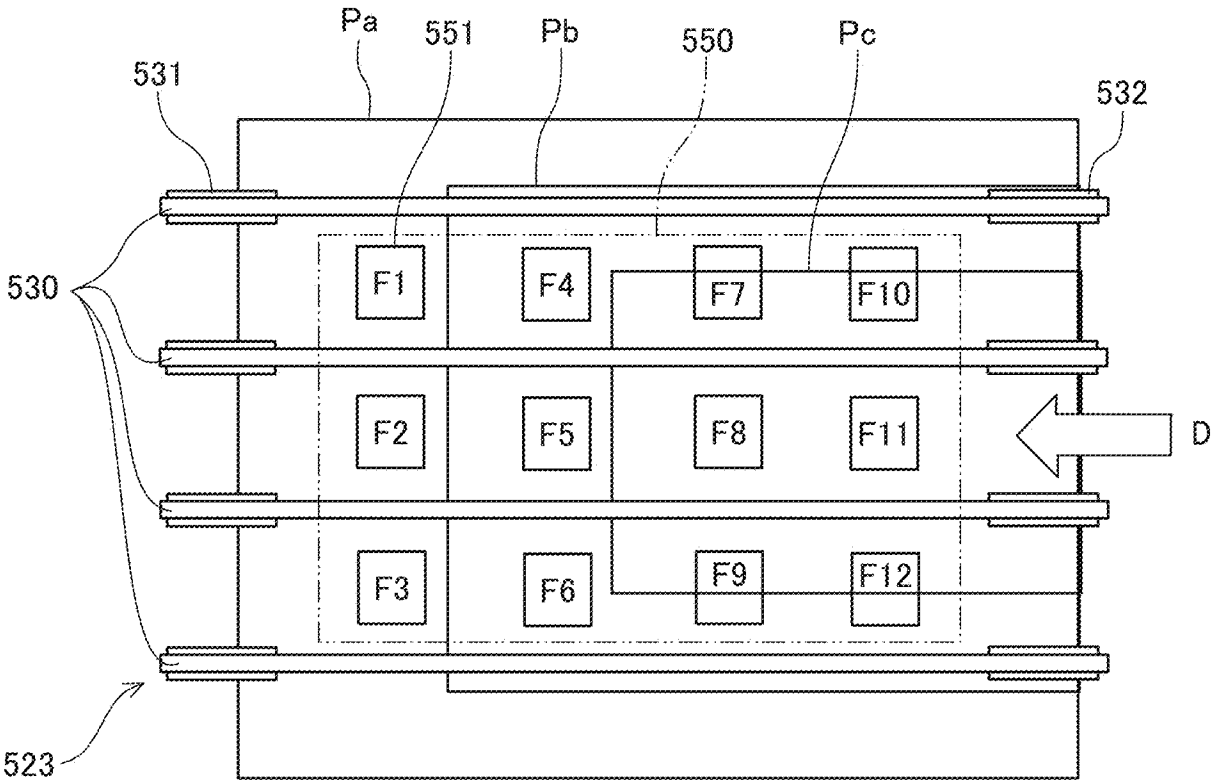
FIG. 3 is a schematic plan view of a guide unit and a blower according to the first embodiment.
Figure 4:
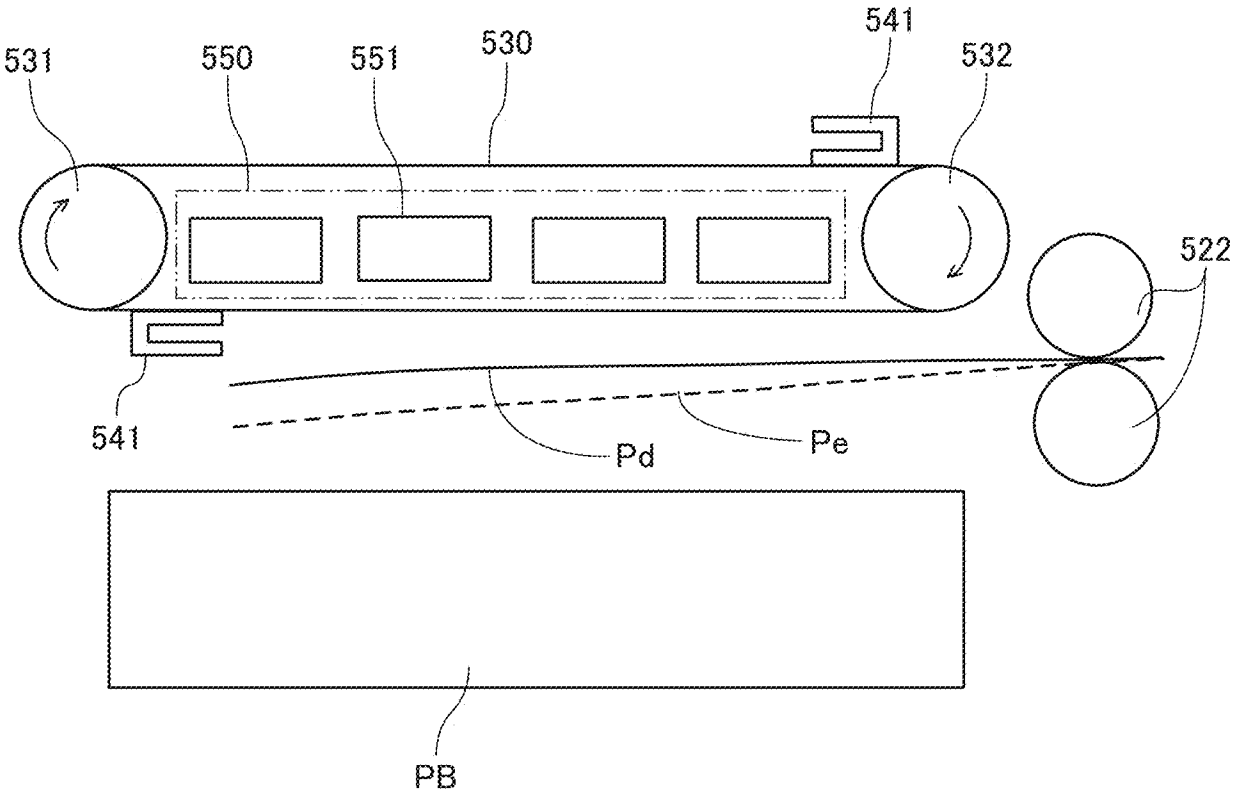
FIG. 4 is a schematic side view of the guide unit and the blower according to the first embodiment.

Next, the guide unit 523 and the blower 550 according to the first embodiment is described with reference to FIGS. 3 to 4. FIG. 3 is a plan view of the guide unit 523, and FIG. 4 is a side view of the guide unit 523.

In the guide unit 523, multiple belts 530 (four in the present embodiment) are disposed at intervals in the direction perpendicular to the sheet conveyance direction. Each of the multiple belts 530 is looped around the drive roller 531 and the driven roller 532. The multiple drive rollers 531 are coaxial with each other, the multiple driven rollers 532 are coaxial with each other, and each belt 530 circumferentially rotates at the same linear velocity. Each belt 530 is provided with the guide parts 541.

The blower 550 includes fans 551F1 to 551F12 serving as airflow generators that blow air. Hereinafter, the fans 551F1 to 551F12 are also collectively referred to as "fans 551", and one of the fans 551F1 to 551F12 is referred to as a "fan 551" unless distinguished. The fans 551 are arranged in three lines in the sheet conveyance direction and each line of the fans 551 is disposed between the belts 530 side by side in the direction perpendicular to the sheet conveyance direction.

That is, the belt 530 is divided into the multiple belts 530 to move the guide parts 541, and the multiple belts 530 are disposed at the intervals. Each fan 551 of the blower 550 is disposed adjacent to the belt 530 in the direction perpendicular to the sheet conveyance direction. Accordingly, the size of the guide unit 523 can be downsized as compared with a case in which the fans 551 (blower 550) are disposed above the belt 530.

Here, a sheet Pa having the maximum size, a sheet Pb having the medium size, and a sheet Pc having the minimum size are stacked at the respective stacking positions in the stacker 501 as illustrated in FIG. 3. At that time, as viewed in the plan view (as viewed in the direction perpendicular to the surface of the sheet P), the fans 551F1 to 551F3 are disposed at positions facing only the sheet Pa having the maximum size. Similarly, the fans 551F4 to 551F6 are disposed at positions facing the sheet Pa having the maximum size and the sheet Pb having the medium size.

Similarly, the fans 551F7, 551F9, 551F10, and 551F12 are disposed at positions facing the sheet Pa having the maximum size and the sheet Pb having the medium size, and portions of the fans 551F7, 551F9, 551F10, and 551F12 face the sheet Pc having the minimum size. Similarly, the fans 551F8 and 551F11 are disposed at positions facing all of the sheet Pa having the maximum size, the sheet Pb having the medium size, and the sheet Pc having the minimum size. Accordingly, the blower 550 can change the fans 551F1 to 551F12 to be driven, so that a region of the blower 550 from which air is blown is changeable.

Figure 5:
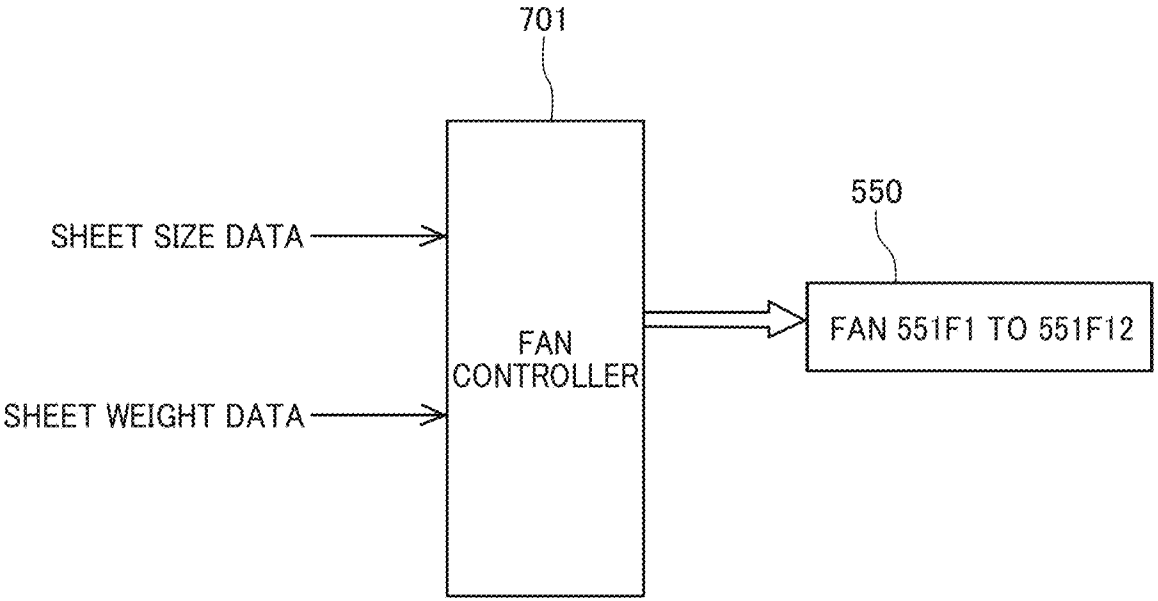
FIG. 5 is a block diagram illustrating a configuration for controlling fans of the blower according to the first embodiment.

A configuration for controlling fans 551 according to the present embodiment is described with reference to a block diagram in FIG. 5. A fan controller 701 causes the multiple fans 551F1 to 551F12 of the blower 550 to rotate. The fan controller 701 receives the size of the sheet P to be guided (i.e., sheet size data), and selects the fans 551 to be rotationally driven in response to the size of the sheet P to be guided.

As described above, the fan controller 701 selects (changes) one or more of the fans 551 to be rotationally driven from the multiple fans 551F1 to 551F12 so as to change the region of the blower 550 from which air is blown in response to the size of the sheet P to be guided to blow the air within an area of the sheet P to be guided.

For example, the fans 551F1 to 551F12 are rotationally driven to blow air within the area of the sheet Pa having the maximum size to guide the sheet Pa having the maximum size. The fans 551F4 to 551F12 are rotationally driven to blow air within the area of the sheet Pb having the medium size to guide the sheet Pb having the medium size. At that time, as viewed in plan view, the fans 551F1 to 551F3 positioned outside the sheet Pb having the medium size are not used. Therefore, air is not blown outside the sheet Pb. The fans 551F8 and 551F11 are rotationally driven to blow air within the area of the sheet Pc having the minimum size to guide the sheet Pc having the minimum size. At that time, as viewed in plan view, the fans 551F1 to 551F6 entirely facing an area outside the sheet Pc having the minimum size and the fans 551F7, 551F9, 551F10, and 551F12 partially facing the area outside the sheet Pc are not used. Therefore, air is not blown outside the sheet Pc. Thus, air is blown within the area of the guided sheet P, and air is not blown outside the guided sheet P, thereby stably guiding the sheet P.

Further, the fan controller 701 receives the weight of the sheet P to be guided (i.e., sheet weight data), and changes an amount of air (flow rate) blown from the driven fans 551 of the blower 550 in response to the weight of the sheet P to be guided. For example, the fan controller 701 changes a duty ratio of pulse-width modulation (PWM) control or changes a rotation speed to drive the fans 551, thereby changing the amount of blowing air.

For example, as illustrated in FIG. 4, when a sheet Pd is heavier than a sheet Pe, the fan controller 701 controls the fans 551 so that the amount of blowing air to the sheet Pd is greater than the amount blowing air to the sheet Pe. Thus, buckling of the sheet P having low stiffness can be prevented, thereby stably guiding the sheet P.

Figure 6:
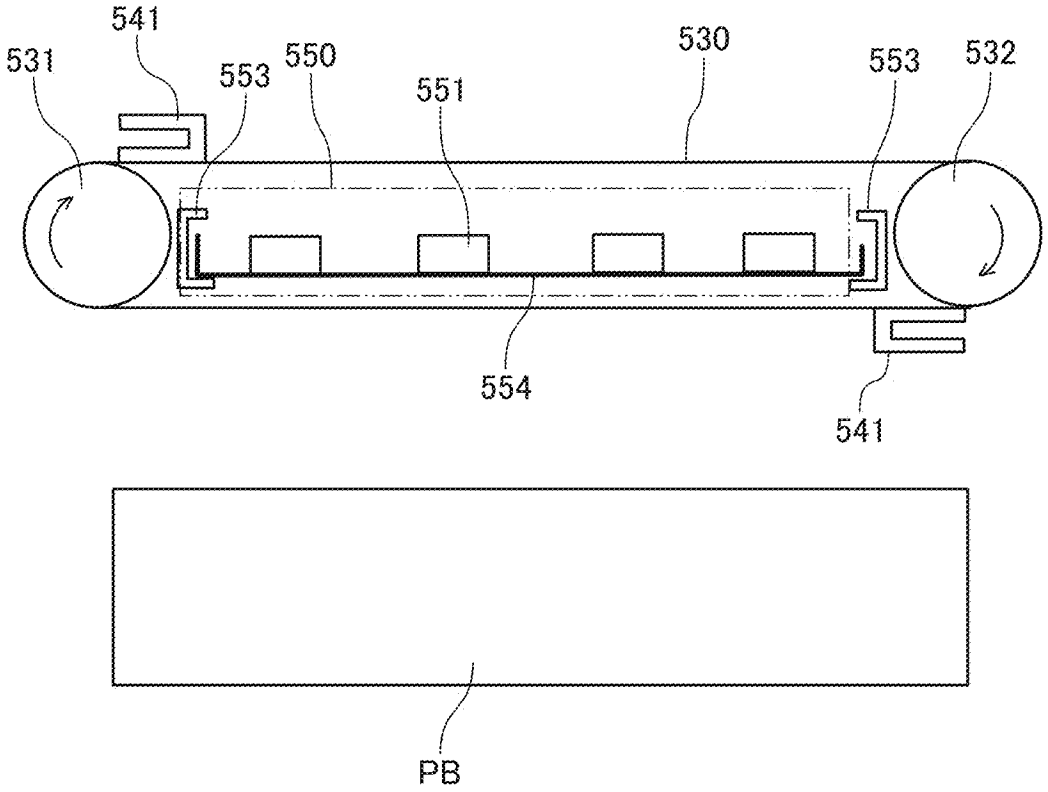
FIG. 6 is a schematic side view of a guide unit and a blower according to a second embodiment of the present disclosure.

Next, a second embodiment of the present disclosure is described with reference to FIG. 6. FIG. 6 is a schematic side view of the guide unit 523 and the blower 550 according to the second embodiment. In the present embodiment, guide rails 553 are disposed in the direction perpendicular to the sheet conveyance direction so as to penetrate through the loops of the multiple belts 530. The guide rails 553 movably supports a fan holder 554, and the fans 551 included in the blower 550 is mounted (held) on the fan holder 554. That is, the fan holder 554 as a holder holding the blower 550 is movable in the direction perpendicular to the sheet conveyance direction in the loops of the multiple belts 530. Accordingly, the fan holder 554 is drawn in the direction perpendicular to the sheet conveyance direction to pull out the multiple fans 551 together.

Figure 7:
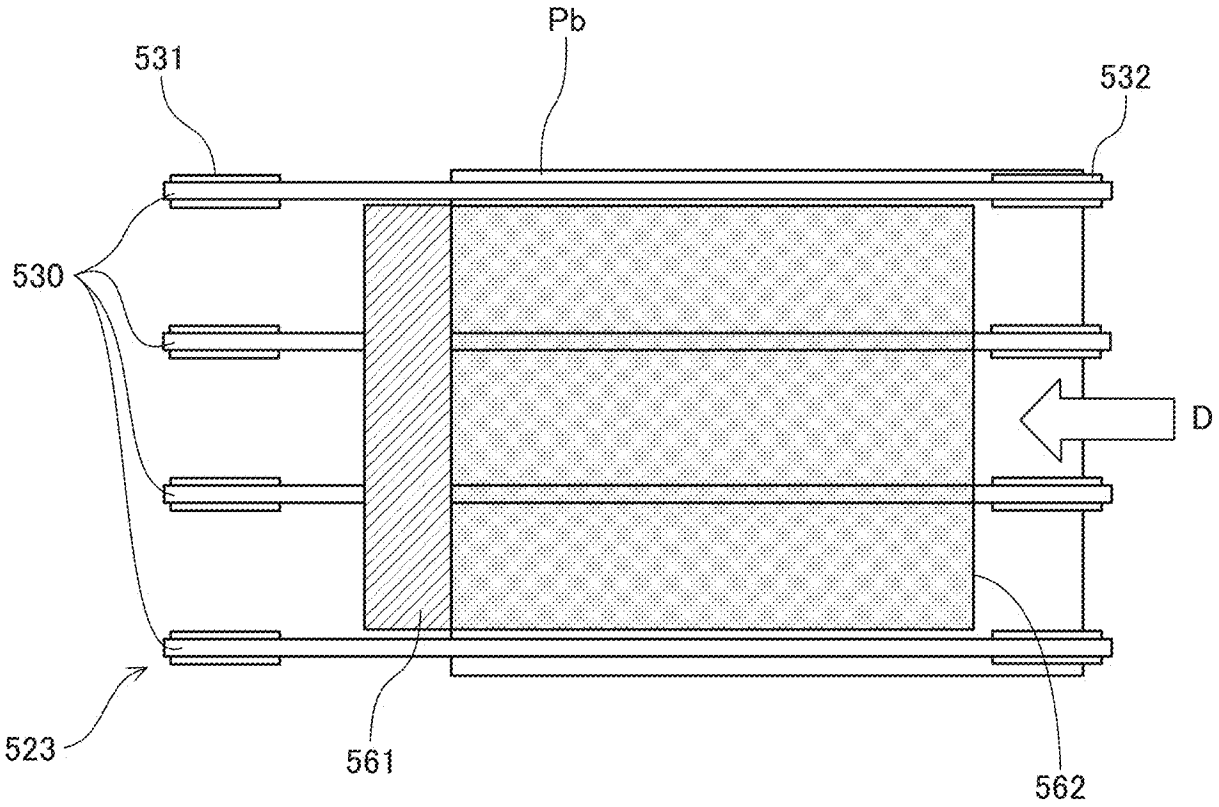
FIG. 7 is a schematic plan view of a guide unit and a blower according to a third embodiment of the present disclosure.

Next, a third embodiment of the present disclosure is described with reference to FIG. 7. FIG. 7 is a schematic plan view of the guide unit 523 according to the third embodiment. In the present embodiment, the blower 550 includes one airflow generator or multiple airflow generators (for example, the fans 551 in the above-described embodiment), and further includes a shutter 561 that opens and closes a region through which the airflow generated by the airflow generator passes to change the region from which air is blown. In the example in FIG. 7, the shutter 561 covers the region of the fans 551F1 to 551F3 illustrated in FIG. 3, thereby opening a region 562 facing the sheet Pb so that air can pass therethrough. Thus, the number of airflow generators (e.g., the fans 551) can be reduced as compared with the first embodiment.

Figure 8A:
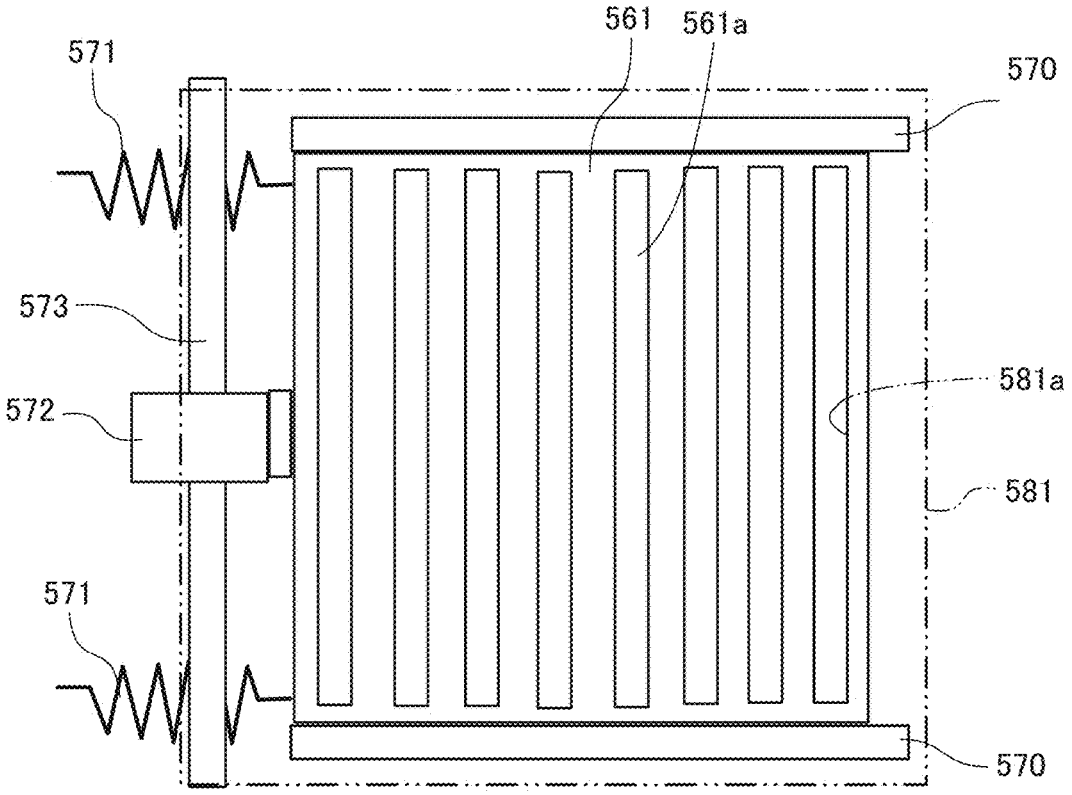
FIGS. 8A and 8B are schematic plan views illustrating an example of an opening and closing mechanism of a shutter according to the third embodiment.
Figure 8B:
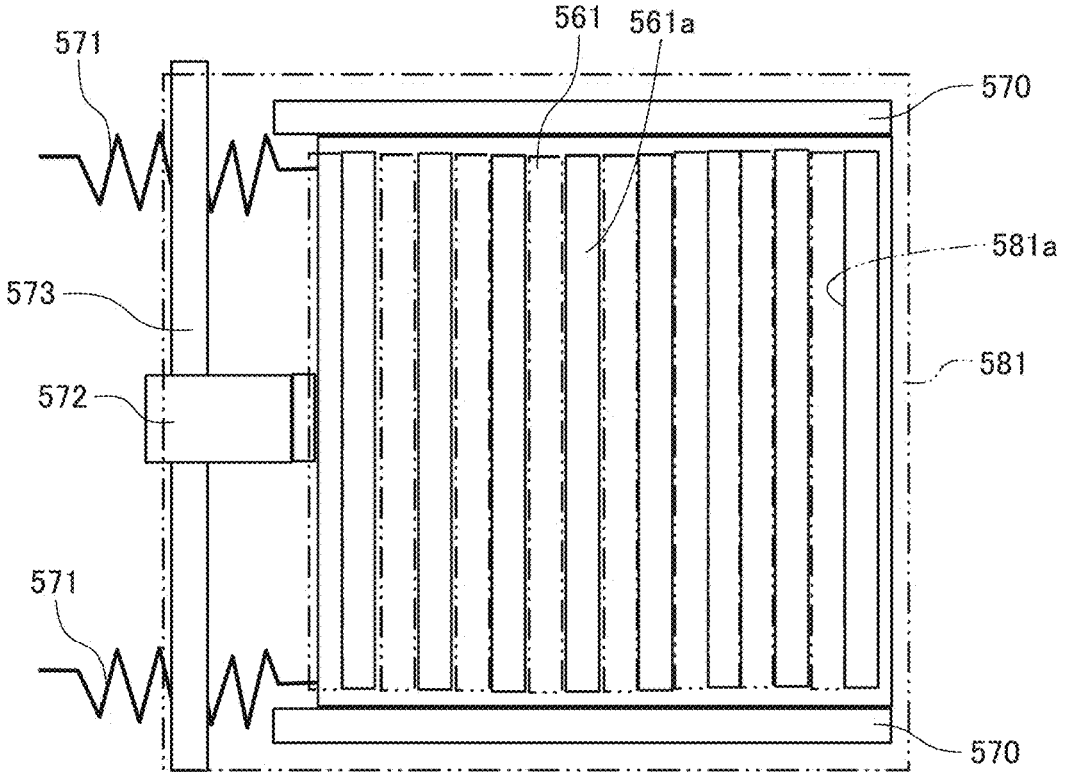

Here, an example of an opening and closing mechanism of the shutter 561 is described with reference to FIGS. 8A and 8B. FIGS. 8A and 8B are schematic plan views of the opening and closing mechanism of the shutter 561. The shutter 561 is movably held by guides 570. The shutter 561 is moved along the guides 570 by a cam 572 attached to a cam shaft 573. The shutter 561 is pressed against the cam 572 by springs 571. The shutter 561 has an opening 561*a*, and an opposing member 581 having an opening 581*a* is disposed facing the shutter 561 (on the side facing the sheet P). The opposing member 581 has the opening 581*a* through which the blower 550 blows air.

In the opening and closing mechanism, when the cam 572 is in the state illustrated in FIG. 8A, the shutter 561 is at the open position where the opening 561*a* of the shutter 561 coincides with the opening 581*a* of the opposing member 581 by biasing force of the springs 571. At that time, the air blown by the blower 550 is blown toward the sheet P. On the other hand, as illustrated in FIG. 8B, as the cam 572 is rotationally driven to move the shutter 561 against the biasing force of the springs 571, the shutter 561 is at the closed position where the opening 561*a* of the shutter 561 does not coincide with the opening 581*a* of the opposing member 581. At that time, air is not blown toward the sheet P from the blower 550.

Figure 9:
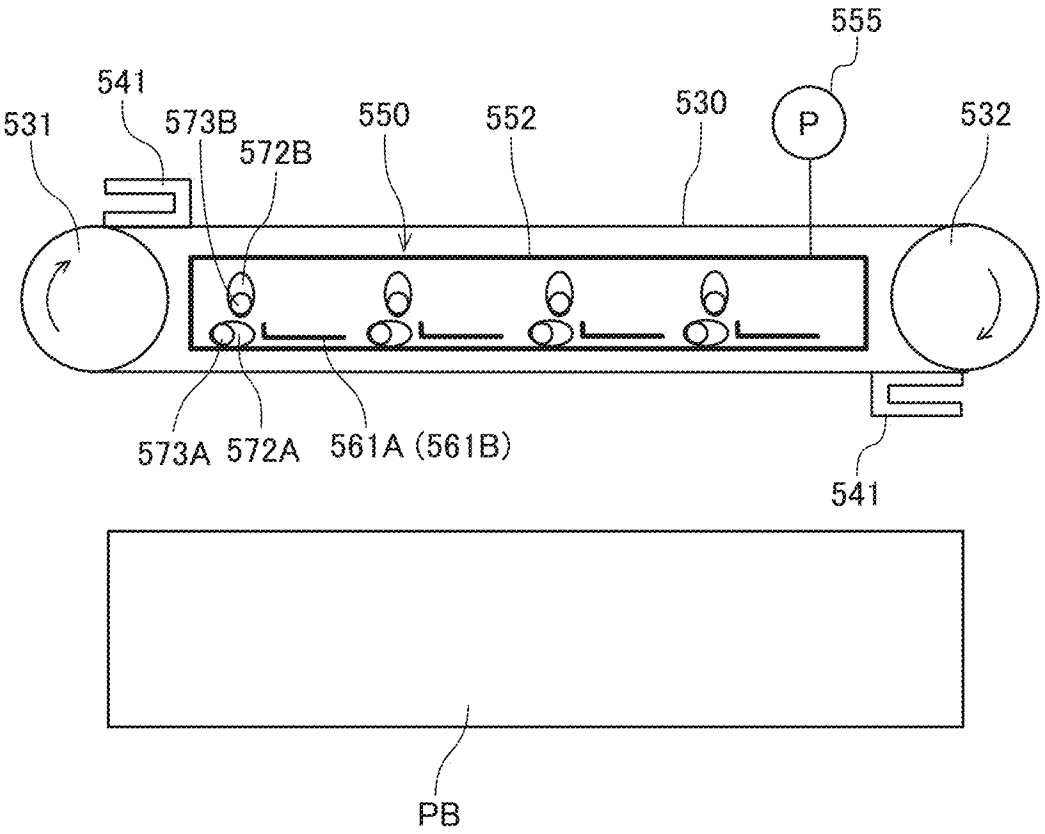
FIG. 9 is a schematic side view of a guide unit and a blower according to a fourth embodiment of the present disclosure.
Figure 10:
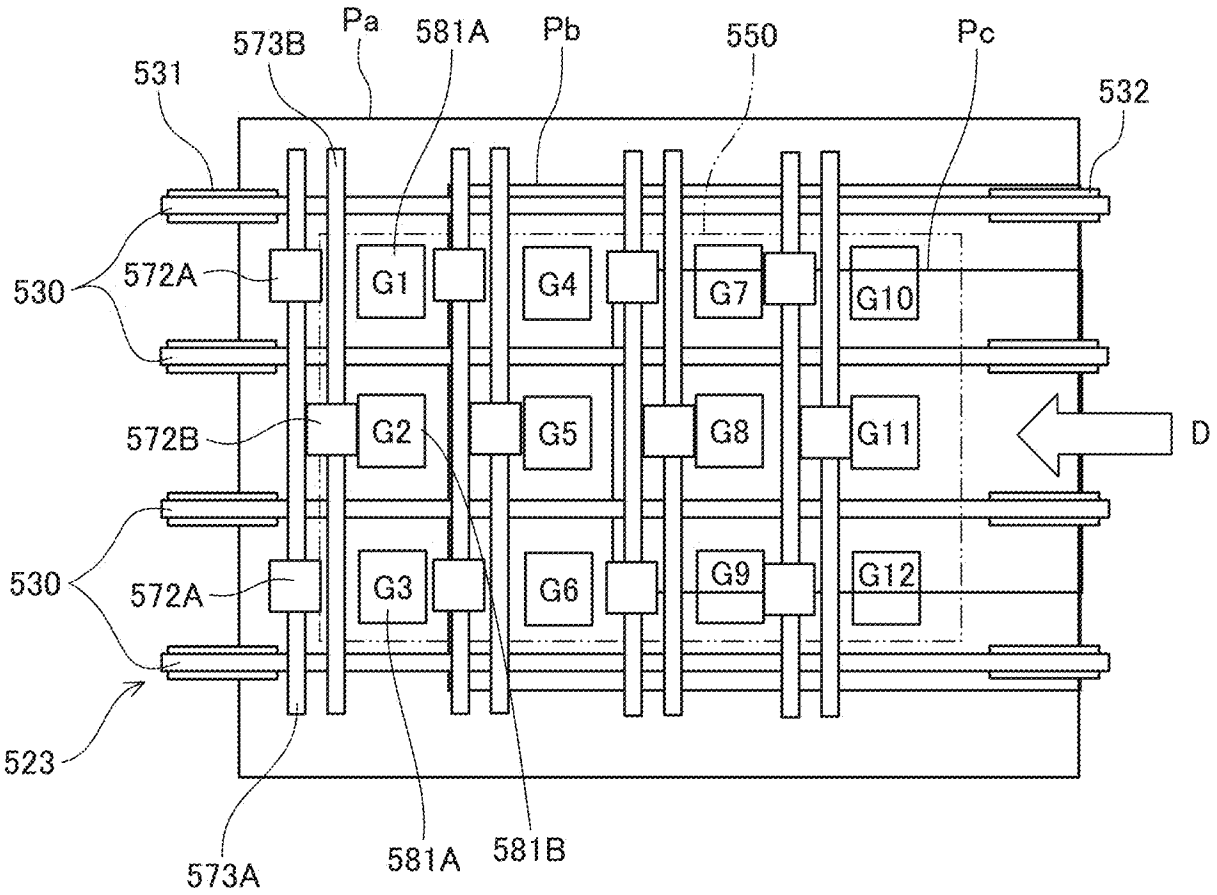
FIG. 10 is a schematic plan view of the guide unit and the blower according to the fourth embodiment.

A fourth embodiment of the present disclosure is described with reference to FIGS. 9 and 10. FIG. 9 is a schematic side view of the guide unit 523 and the blower 550 according to the fourth embodiment. FIG. 10 is a schematic plan view of the guide unit 523 and the blower 550 according to the fourth embodiment. In the present embodiment, the blower 550 includes a chamber 552 and a pump 555 that pumps air into the chamber 552. In the chamber 552, an opening 581A or 581B through which air is blown out is disposed at each of positions G1 to G12. The positions G1 to G12 correspond to the positions of the fans 551F1 to 551F12 described in the above embodiment. The openings 581B are disposed at the center and the openings 581A are disposed on both sides in the direction perpendicular to the sheet conveyance direction.

As illustrated in FIG. 9, shutters 561A and shutters 561B that open and close the openings 581A and the openings 581B, respectively, are movably disposed in the chamber 552. Cams 572A and cams 572B are pressed against the shutters 561A and the shutters 561B, respectively. Similarly to the third embodiment, each of the shutters 561A and 561B is biased by a biasing member such as a spring to be pressed against the corresponding cam 572A or 572B.

That is, in the direction perpendicular to the conveyance direction of the sheet P, the cams 572A drive the shutters 561A to open and close the openings 581A on both sides, and the cams 572B drive the shutters 561B that open and close the openings 581B at the center. The cam 572A is attached to a camshaft 573A, and the cam 572B is attached to a camshaft 573B. Thus, an open area of the opening 581A on both sides, which the shutter 561A opens and closes, and an open area of the opening 581B at the center, which the shutter 561B opens and closes, can be controlled independently.

Note that the printing unit 30 of the printing apparatus 1 in each of the above-described embodiments ma fix toners onto the sheet P to perform a desired printing operation to the sheet P instead of discharging liquid such as ink onto the sheet P to perform the desired printing operation.

A material of the sheet P to be conveyed is not limited to a paper, and the sheet stacking device according to the present disclosure may also be applied to an apparatus to convey a plastic film, cloth, metal sheet, and the like.

As described above, according to the present disclosure, the sheet can be stably guided.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A sheet stacking device comprising:

a conveyance roller pair configured to guide a sheet in a sheet conveyance direction, a guide unit configured to receive a downstream end of the sheet conveyed in the sheet conveyance direction directly from the conveyance roller pair and guide the sheet downstream in the sheet conveyance direction, the guide unit separated from the conveyance roller pair; and a blower configured to blow air perpendicular to and toward a face of the sheet guided by the guide unit, a region of the blower from which the air is blown being changeable in response to a size of the sheet.

2. The sheet stacking device according to claim 1, wherein an amount of the air blown from the blower is changeable in response to a weight of the sheet guided by the guide unit.

3. The sheet stacking device according to claim 1, wherein the blower includes multiple airflow generators, and wherein the region of the blower from which the air is blown is changeable by changing one or more of the multiple airflow generators to be driven.

4. The sheet stacking device according to claim 3, wherein the guide unit includes multiple endless belts configured to circumferentially rotate, wherein the multiple endless belts are disposed at an interval in a direction perpendicular to the sheet conveyance direction, and wherein the multiple airflow generators are disposed between the multiple endless belts.

5. The sheet stacking device according to claim 1, further comprising a holder holding the blower, wherein the guide unit includes an endless belt configured to circumferentially rotate, and wherein the holder is configured to move in a direction perpendicular to the sheet conveyance direction in a loop of the endless belt.

6. The sheet stacking device according to claim 1, wherein the blower includes:

an opposing member having an opening through which the blower blows the air; and a shutter facing the opposing member, the shutter configured to open and close the opening.

7. A printing apparatus comprising:

the sheet stacking device according to claim 1; and an image forming unit disposed upstream from the sheet stacking device in the sheet conveyance direction and configured to perform printing on the sheet.

8. The sheet stacking device according to claim 1, wherein the guide unit includes a guide part having a gap with a wider thickness than a thickness of the sheet, the guide part configured to contact and guide a leading end of the sheet without gripping the sheet.

9. A sheet stacking device comprising:

a guide unit configured to receive a downstream end of a sheet conveyed in a sheet conveyance direction and guide the sheet downstream in the sheet conveyance direction, the guide unit including multiple endless belts configured to circumferentially rotate, the multiple endless belts being disposed at an interval in a direction perpendicular to the sheet conveyance direction; and a blower including multiple airflow generators and configured to blow air toward the sheet guided by the guide unit, a region of the blower from which the air is blown being changeable in response to a size of the sheet, the multiple airflow generators are disposed between the multiple endless belts.

10. The sheet stacking device according to claim 9, wherein an amount of the air blown from the blower is changeable in response to a weight of the sheet guided by the guide unit.

11. The sheet stacking device according to claim 9, wherein the region of the blower from which the air is blown is changeable by changing one or more of the multiple airflow generators to be driven.

12. The sheet stacking device according to claim 9, further comprising a holder holding the blower, wherein the guide unit includes an endless belt configured to circumferentially rotate, and wherein the holder is configured to move in a direction perpendicular to the sheet conveyance direction in a loop of the endless belt.

13. The sheet stacking device according to claim 9, wherein the blower includes:

an opposing member having an opening through which the blower blows the air; and a shutter facing the opposing member, the shutter configured to open and close the opening.

14. A printing apparatus comprising:

the sheet stacking device according to claim 9; and an image forming unit disposed upstream from the sheet stacking device in the sheet conveyance direction and configured to perform printing on the sheet.

* * * * *